US005509603A

United States Patent [19]

Hering

[11] Patent Number: 5,509,603

[45] Date of Patent: Apr. 23, 1996

[54] MAILBOX MOUNTING BRACKET

[76] Inventor: Thomas W. Hering, 26690 NW. Meek Rd., Hillsboro, Oreg. 97124

[21] Appl. No.: 347,672

[22] Filed: Dec. 1, 1994

[51] Int. Cl.[6] ..... B65D 91/00

[52] U.S. Cl. ..... 232/39

[58] Field of Search ..... 232/39, 17; 248/146

[56] References Cited

U.S. PATENT DOCUMENTS

| | | | |
|---|---|---|---|
| 3,407,997 | 10/1968 | Wood et al. | 232/39 |
| 4,403,730 | 9/1983 | Batson | 232/39 |
| 4,709,853 | 12/1987 | Hahn | 232/39 |
| 4,951,905 | 8/1990 | Bronson et al. | 232/39 |
| 5,337,954 | 8/1994 | Kobilarcik et al. | 232/39 |
| 5,386,938 | 2/1995 | West | 232/39 |

*Primary Examiner*—Michael J. Milano

[57] ABSTRACT

A bracket for mounting a mailbox to a supporting structure. The inventive device includes a coupling assembly securable to a bottom of a mailbox to be mounted. A mounting assembly depends for the coupling assembly for securing the mailbox to a supporting structure, such as a post, a piercable surface, or poured concrete.

2 Claims, 3 Drawing Sheets

MAILBOX MOUNTING BRACKET

BACKGROUND OF THE INVENTION

1. Field of the Invention

The present invention relates to bracket structures and more particularly pertains to a mailbox mounting bracket for mounting a mailbox to a supporting structure.

2. Description of the Prior Art

The use of bracket structures is known in the prior art. More specifically, bracket structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art bracket structures include U.S. Pat. No. 4,546,944; U.S. Pat. No. 4,236,665; U.S. Pat. No. 3,498,576 and U.S. Pat. No. 3,721,463.

While these devices fulfill their respective, particular objectives and requirements, the aforementioned patents do not disclose a mailbox mounting bracket for mounting a mailbox to a supporting structure which includes a coupling assembly securable to a bottom of mailbox to be mounted, and a mounting assembly depending from the coupling assembly for securing the mailbox to a supporting structure such as a post, a piercable surface, or poured concrete.

In these respects, the mailbox mounting bracket according to the present invention substantially departs from the conventional concepts and designs of the prior art, and in so doing provides an apparatus primarily developed for the purpose of mounting a mailbox to a supporting structure.

SUMMARY OF THE INVENTION

In view of the foregoing disadvantages inherent in the known types of bracket structures now present in the prior art, the present invention provides a new mailbox mounting bracket construction wherein the same can be utilized for mounting a mailbox to a supporting structure. As such, the general purpose of the present invention, which will be described subsequently in greater detail, is to provide a new mailbox mounting bracket apparatus and method which has many of the advantages of the bracket structures mentioned heretofore and many novel features that result in a mailbox mounting bracket which is not anticipated, rendered obvious, suggested, or even implied by any of the prior art bracket structures, either alone or in any combination thereof.

To attain this, the present invention generally comprises a bracket for mounting a mailbox to a supporting structure. The inventive device includes a coupling assembly securable to a bottom of a mailbox to be mounted. A mounting assembly depends for the coupling assembly for securing the mailbox to a supporting structure, such as a post, a piercable surface, or poured concrete.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivaient constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mailbox mounting bracket apparatus and method which has many of the advantages of the bracket structures mentioned heretofore and many novel features that result in a mailbox mounting bracket which is not anticipated, rendered obvious, suggested, or even implied by any of the prior art bracket structures, either alone or in any combination thereof.

It is another object of the present invention to provide a new mailbox mounting bracket which may be easily and efficiently manufactured and marketed.

It is a further object of the present invention to provide a new mailbox mounting bracket which is of a durable and reliable construction.

An even further object of the present invention is to provide a new mailbox mounting bracket which is susceptible of a low cost of manufacture with regard to both materials and labor, and which accordingly is then susceptible of low prices of sale to the consuming public, thereby making such mailbox mounting brackets economically available to the buying public.

Still yet another object of the present invention is to provide a new mailbox mounting bracket which provides in the apparatuses and methods of the prior art some of the advantages thereof, while simultaneously overcoming some of the disadvantages normally associated therewith.

Still another object of the present invention is to provide a new mailbox mounting bracket for mounting a mailbox to a supporting structure, such as a post, a piercable surface, or poured concrete.

Yet another object of the present invention is to provide a new mailbox mounting bracket which includes a coupling assembly securable to a bottom of mailbox to be mounted, and a mounting assembly depending from the coupling assembly for securing the mailbox to a supporting structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
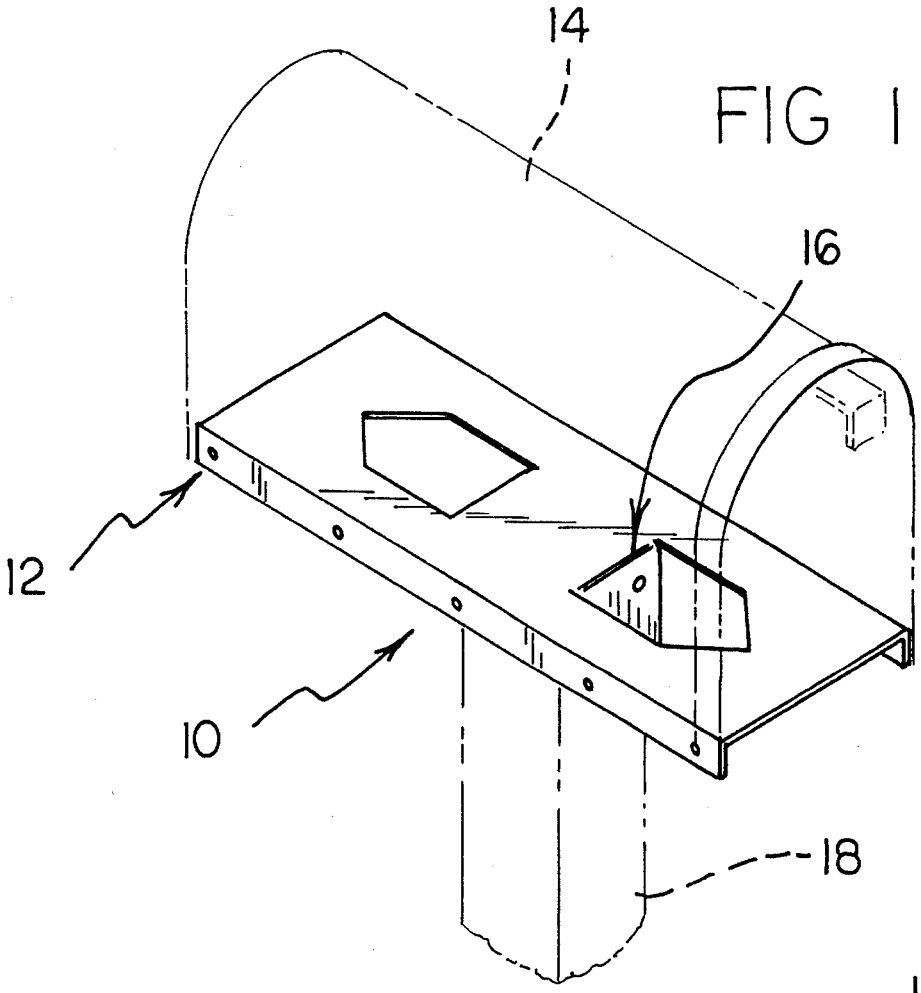
FIG. 1 is an isometric illustration of a mailbox mounting bracket according to the present invention in use.

With reference now to the drawings, and in particular to FIGS. 1–6 thereof, a new mailbox mounting bracket embodying the principles and concepts of the present invention and generally designated by the reference numeral 10 will be described.

Figure 2:
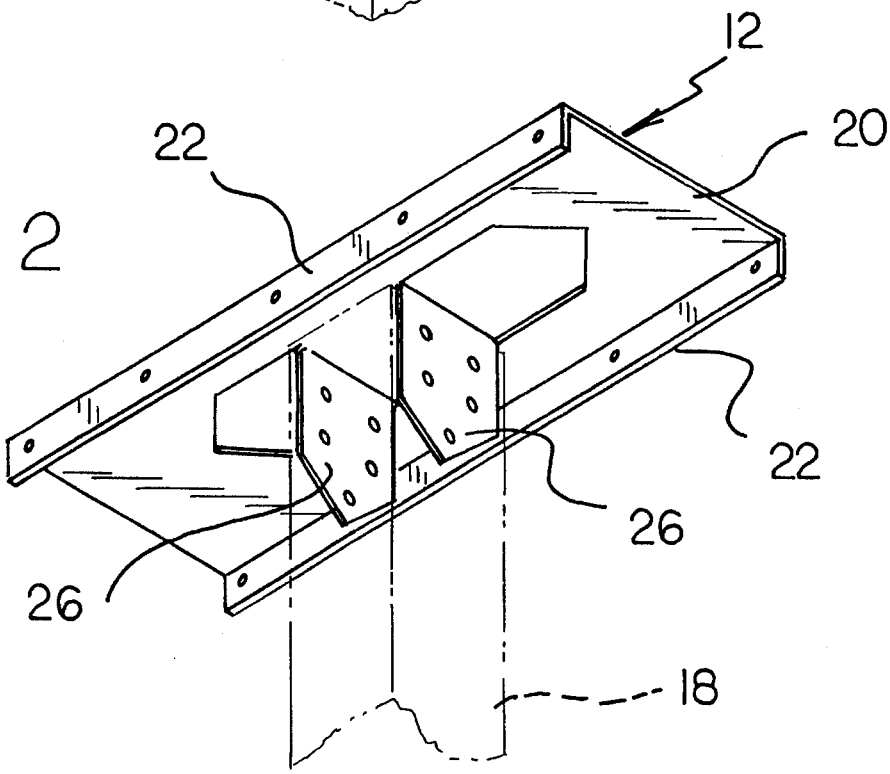
FIG. 2 is a bottom isometric illustration of the mailbox mounting bracket.
Figure 3:
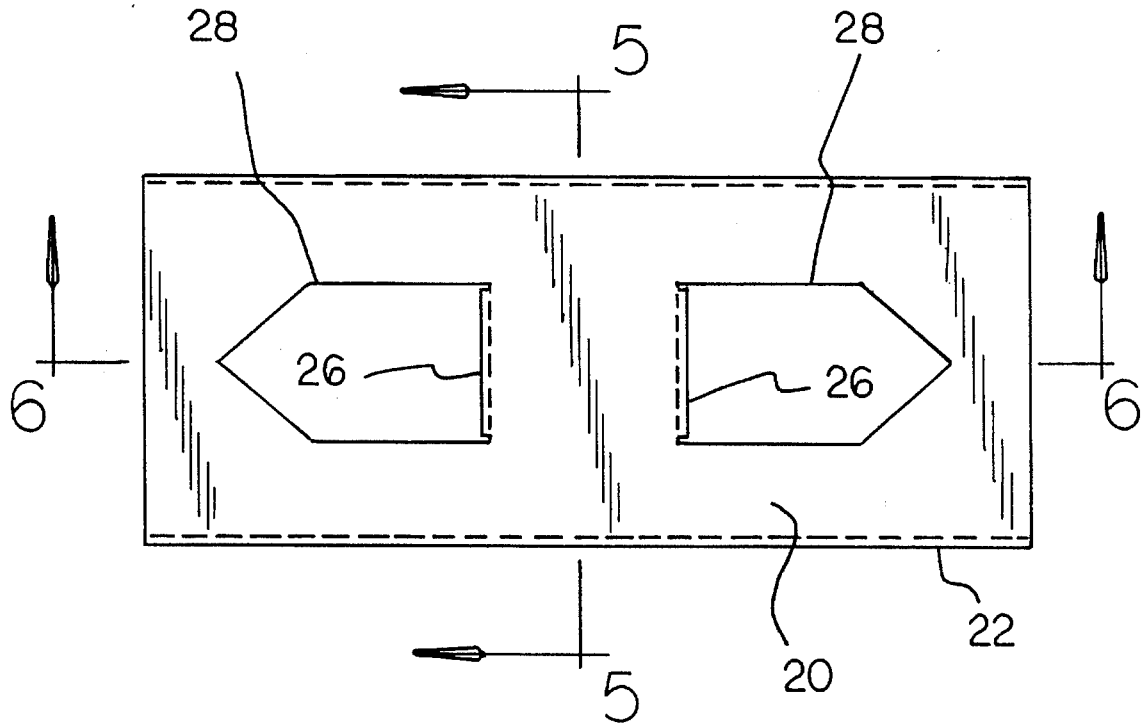
FIG. 3 is a top plan view thereof.

More specifically, it will be noted that the mailbox mounting bracket 10 comprises a coupling means 12 for coupling to a lower portion of a mailbox 14, and a mounting means 16 secured to the coupling means 12 for attaching to a supporting structure, such as the post 18 illustrated in FIGS. 1 and 2.

As shown in FIGS. 2 through 6, the coupling means 12 according to the present invention 10 preferably comprises a substantially rectangular and planar base plate 20 sized to fit along a bottom of a mailbox 14 to be mounted. The planar base plate 20 includes respectively opposed longitudinal side edges from which a pair of depending lateral side walls 22 downwardly extend. The depending lateral side walls 22 are integrally or otherwise fixedly secured to the longitudinal side edges of the planar base plate 20 and preferably include a plurality of mounting apertures 24 directed therethrough which permit a passage of threaded fasteners or the like to facilitate securement of the coupling means 12 to mailbox 14. In this connection, the coupling means 12 can be positioned over and into an abutting relationship with a bottom wall of the mailbox 14, or alternatively, the coupling means 12 can replace the bottom wall of the mailbox during construction thereof. In other words, the coupling means 12 can be integrally formed as a portion of the mailbox 14, if desired.

Figure 5:
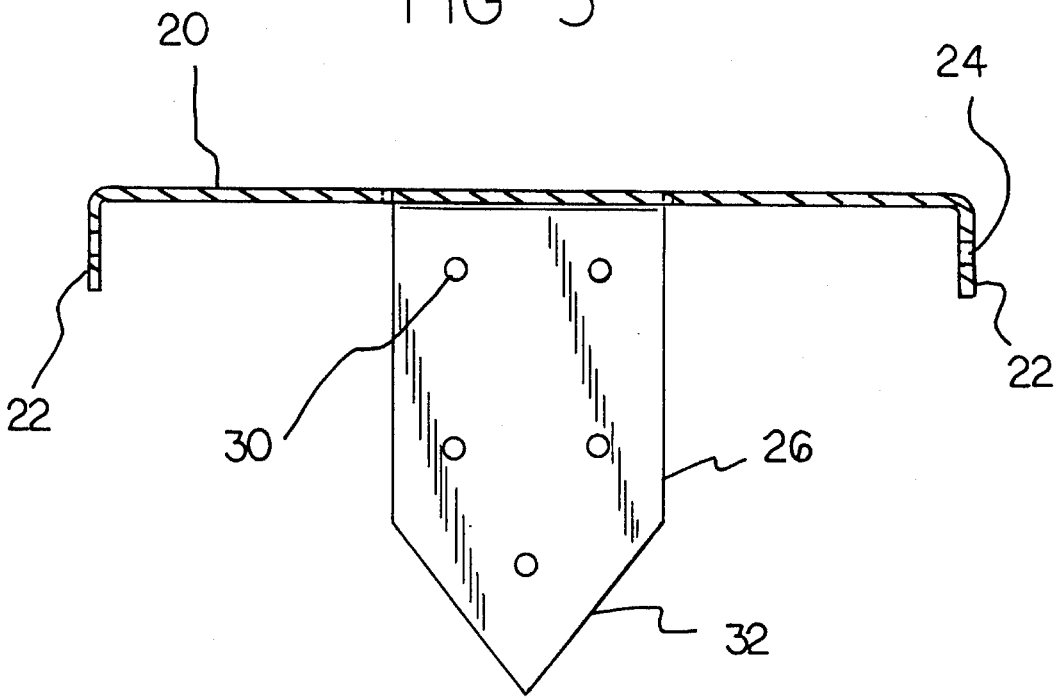
FIG. 5 is a cross sectional view taken along line 5—5 of FIG. 3.
Figure 6:
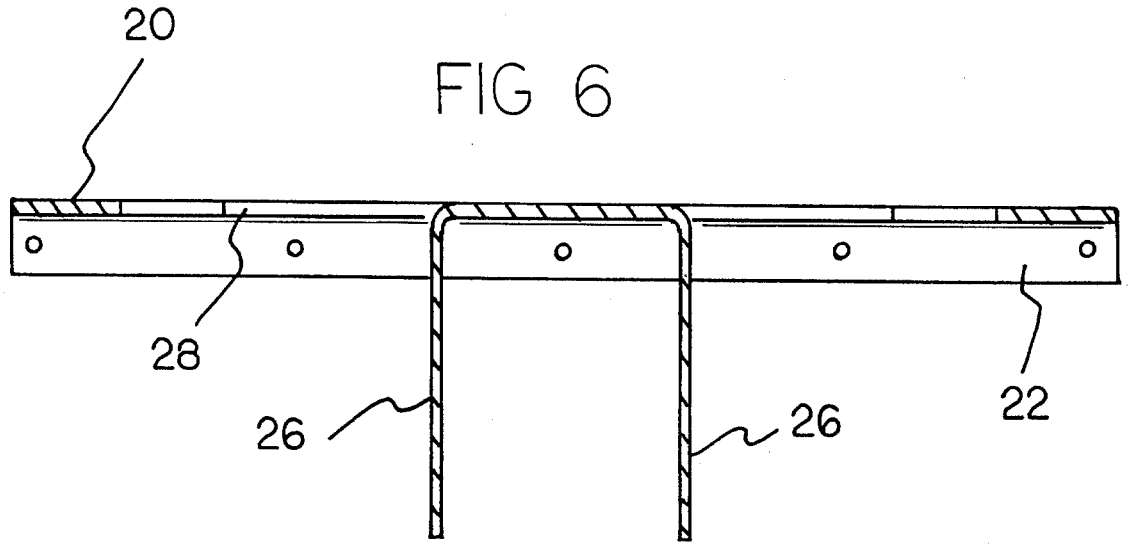
FIG. 6 is a cross sectional illustration taken along line 6—6 of FIG. 3.

To facilitate mounting of the coupling means 12 to a supporting structure, such as the post 18 illustrated in herein, the mounting means 16 preferably comprises a pair of spaced and substantially parallely oriented mounting tabs 26 which project downwardly from the planar base plate 20 and can be positioned upon opposed sides of the post 18. The mounting tabs 26 are fixedly secured to a bottom surface of the planar base plate 20, and can be integrally formed therewith wherein a pair of oppositely oriented cut-outs 28 are formed in the planar base plate 20 to define the mounting tabs 26 which are then bent downwardly into the position illustrated herein. As shown in FIG. 5, the mounting tabs 26 preferably include a plurality of further mounting apertures 30 which permit the direction of further threaded fasteners therethrough to engage the supporting structure 18 to secure the entire device 10 and associated mailbox 14 thereto.

Figure 4:
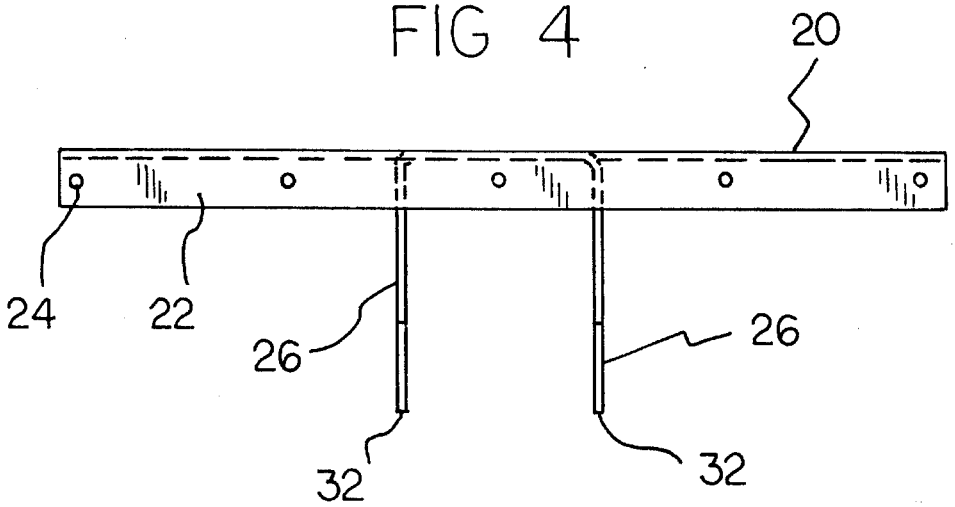
FIG. 4 is a side elevation view of the present invention.

As shown in FIGS. 4 and 5, each of the mounting tabs 26 is shaped so as to define a piercing tip 32 operable to engage and secure a piercable surface, such as a wooden plank or the like. By this structure, the mounting tabs 26 can be driven into a support structure to which the device 10 is to be secured. Further, the mounting tabs 26 can also be molded into poured concrete to secure the mailbox mounting bracket 10 to such a concrete structure. In this mounting of the device 10, the mounting apertures 30 permit the cement to flow through the mounting tabs 26 to create an interference fit which retains the mounting means 16 relative to the concrete. As shown in FIG. 5, each of the mounting tabs 26 is shaped so as to define substantially spaced and parallel unlabeled lateral edges, and a pair of angled piercing edges (not labeled) which each intersect an individual one of the lateral edges. The angled piercing edges also intersect each other to define the piercing tip 32 which is operable to engage and secure a piercable substrate.

In use, the mailbox mounting bracket 10 according to the present invention can be easily installed to a bottom surface of an associated mailbox 14, whereby the mounting means 16 disclosed herein can be utilized to secure the mailbox 14 to a supporting structure, such as the post 18, a piercable surface or plank, or poured concrete.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it ms not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A mailbox mounting bracket comprising:

a coupling means for coupling to a lower portion of a mailbox, the coupling means comprising a planar base plate sized to fit along a bottom of a mailbox to be mounted, the planar base plate including respectively opposed longitudinal side edges; and a pair of depending lateral side walls extending downwardly from the respectively opposed longitudinal side edges of the planar base plate, the depending lateral side walls including a plurality of mounting apertures directed therethrough; and, a mounting means secured to the coupling means for attaching to a supporting structure, the mounting means comprising a pair of spaced and substantially parallely oriented mounting tabs which project downwardly from the planar base plate, the mounting tabs being coupled directly to the planar base plate and projecting orthogonally therefrom, the mounting tabs each being shaped so as to define substantially spaced and parallel lateral edges, and a pair of angled piercing edges which each intersect an individual one of the lateral edges, the angled piercing edges intersecting each other to define a piercing tip operable to engage and secure a piercable substrate.

2. A mailbox mounting bracket comprising:

a post;

a mailbox;

a coupling means for coupling to a lower portion of the mailbox, the coupling means comprising a planar base plate positioned along a bottom of the mailbox, the planar base plate including respectively opposed longitudinal side edges; and a pair of depending lateral side walls extending downwardly from the respectively opposed longitudinal side edges of the planar base plate, the depending lateral side walls including a plurality of mounting apertures directed therethrough; and, a mounting means secured to the coupling means for attaching the coupling means to the post, the post being positioned into abutting engagement with the base plate, the mounting means comprising a pair of spaced and substantially parallely oriented mounting tabs which project downwardly from the planar base plate, the mounting tabs being coupled directly to the planar base plate and projecting orthogonally therefrom so as to abuttingly extend along opposed sides of the post from intersections of the tabs and the planar base plate to lower distal ends of the tabs, the mounting tabs each being shaped so as to define substantially spaced and parallel lateral edges, and a pair of angled piercing edges which each intersect an individual one of the lateral edges, the angled piercing edges intersecting each other to define a piercing tip operable to engage and secure a piercable substrate.

* * * * *